US009683809B2

(12) United States Patent
Fowler

(10) Patent No.: US 9,683,809 B2
(45) Date of Patent: Jun. 20, 2017

(54) LONG GUN HOLSTER SYSTEM FOR MOLLE/PALS-COMPLIANT GARMENTS

(71) Applicant: Paul J. Fowler, Cadillac, MI (US)

(72) Inventor: Paul J. Fowler, Cadillac, MI (US)

( * ) Notice: Subject to any disclaimer, the term of this patent is extended or adjusted under 35 U.S.C. 154(b) by 21 days.

(21) Appl. No.: 14/748,806

(22) Filed: Jun. 24, 2015

(65) Prior Publication Data

US 2015/0377585 A1 Dec. 31, 2015

Related U.S. Application Data

(60) Provisional application No. 62/018,098, filed on Jun. 27, 2014.

(51) Int. Cl.
*F41C 33/00* (2006.01)
*F41C 33/02* (2006.01)
*F41C 33/04* (2006.01)

(52) U.S. Cl.
CPC ..... *F41C 33/0236* (2013.01); *F41C 33/0263* (2013.01); *F41C 33/045* (2013.01)

(58) Field of Classification Search
CPC F41C 33/007; F41C 33/0236; F41C 33/0263; F41C 33/045; F41C 33/003; F41C 33/0245; F41C 33/046; F41C 2200/0591; Y10S 224/913; B60R 7/14
USPC ..... 224/150, 913; 42/85
See application file for complete search history.

(56) References Cited

U.S. PATENT DOCUMENTS

| | | | | |
|---|---|---|---|---|
| 5,564,610 | A * | 10/1996 | Barron | A45F 5/00 224/197 |
| 5,664,721 | A | 9/1997 | Homeyer | |
| 5,779,114 | A | 7/1998 | Owens | |
| 5,881,487 | A | 3/1999 | Chalker | |
| 5,927,574 | A | 7/1999 | Ruesink | |
| 6,325,258 | B1 * | 12/2001 | Verdugo | F41C 33/001 224/149 |
| 7,258,259 | B1 | 8/2007 | Owens | |
| 7,290,688 | B2 | 11/2007 | Pikielny | |
| 7,540,107 | B2 | 6/2009 | Oum | |
| 7,780,048 | B2 * | 8/2010 | Howell | A41D 13/0012 224/196 |
| 8,485,405 | B2 * | 7/2013 | Crye | F41A 9/65 224/251 |
| 8,523,029 | B2 | 9/2013 | Rogers et al. | |
| 8,555,538 | B2 | 10/2013 | Huffines | |
| 2007/0023468 | A1 * | 2/2007 | Ford | F41C 33/045 224/197 |

(Continued)

*Primary Examiner* — Nathan J Newhouse
*Assistant Examiner* — Scott McNurlen
(74) *Attorney, Agent, or Firm* — Price Heneveld LLP

(57) ABSTRACT

A holster apparatus securely holds a long gun on a MOLLE/PALS-compliant garment in a hands-free secure position, but so that the gun is quickly and easily accessible. The apparatus includes a holster with openings configured to slidingly engage an ammunition magazine attached to a long gun, with a bottom surface of the long gun supported on the holster. A mount securely holds the holster on a MOLLE/PALS-compliant garment in a selected balanced position with the long gun oriented generally horizontally, so that a professional can use their hands for tasks while having confidence in the security and safe-carrying of the long gun. The holster can be located anywhere on the garment, and can be oriented as desired by the professional user. Related methods are also described and claimed.

12 Claims, 7 Drawing Sheets

(56) References Cited

U.S. PATENT DOCUMENTS

| | | | | |
|---|---|---|---|---|
| 2014/0053385 | A1* | 2/2014 | Nielsen-Cole | A45F 5/021<br>29/426.1 |
| 2014/0151413 | A1* | 6/2014 | Ponder | F41C 33/046<br>224/149 |
| 2015/0182011 | A1* | 7/2015 | Mccrone | A45F 5/02<br>224/191 |
| 2015/0233669 | A1* | 8/2015 | Ponder | F41C 33/001<br>224/271 |

* cited by examiner

LONG GUN HOLSTER SYSTEM FOR MOLLE/PALS-COMPLIANT GARMENTS

CROSS-REFERENCE TO RELATED APPLICATION

This application claims benefit under 35 USC section 119(e) of U.S. Provisional Application Ser. No. 62/018,098, filed Jun. 27, 2014, entitled LONG GUN HOLSTER SYSTEM FOR MOLLE/PALS-COMPLIANT GARMENTS, the entire contents of which are incorporated herein by reference.

BACKGROUND

The present invention relates to long gun holster systems for MOLLE/PALS-compliant garments, and more particularly relates to a long gun holster system for holding a long gun on the garments hands-free yet in a ready and quickly-available position.

MOLLE/PALS-compliant garments allow tactical gear to be closely held, optimally positioned, and appropriately secured by military personnel, policemen, gun-owners, hunters, and other skilled individuals (generally referred to as "professionals" herein) when doing their job or performing a task requiring use of their hands. However, no known system allows a long gun to be securely held hands-free in a ready-to-use and quickly-available position on the front of the professional wearing the garment. Notably, pistol holsters are known for MOLLE/PALS-compliant garments, but not holsters for long guns, apparently due the additional size, shape, and bulkiness of long guns. Part of the problem appears to be that the holstered long gun must not interfere with other required tasks, so that the wearer can perform urgent tasks without worrying about interference from (or accidental discharge of or damage to) the long gun. As used herein, the phrase "long guns" is used to describe rifles, long-barrel guns, and similar firearms including close quarter weapons intended to fire projectiles/bullets at high speeds and which typically have a barrel of more than 12 inches, often a barrel of 18 inches or more.

An improvement is desired for holding a long gun on a professional garment, such as a MOLLE/PALS-compliant garment, doing so in a manner that provides flexibility, ease of use, and immediate and quick access, and yet that does so securely, safely, and without interfering with tasks at hand, and while using relatively low cost, non-complex components.

SUMMARY OF THE PRESENT INVENTION

In one aspect of the present invention, a holster apparatus is provided for securely holding a long gun on a long-gun-owner's garment, such as a MOLLE/PALS-compliant garment, in a hands-free secure position, where the long gun has an ammunition magazine extending downwardly from generally near a center region of the long gun. The apparatus includes a holster configured to slidingly engage an ammunition magazine attached to a long gun and to engage a bottom surface of the long gun, and a mount for holding the holster on the garment with the holster oriented to hold the long gun in a hands-free manner, so that a professional can use their hands for tasks while having confidence in the security and safe-carrying of the long gun.

In another aspect of the present invention, a method is provided for supporting a long gun on a long-gun-owner's garment, such as a MOLLE/PALS-compliant garment, in a hands-free secure position. The method includes providing a holster configured to slidingly engage an ammunition magazine attached to a long gun and configured to engage a bottom surface of the long gun, attaching the holster on the garment with the holster oriented to hold the long gun in a hands-free manner, and placing the ammunition magazine in the holster with the long gun being supported on the holster, whereby a professional can use their hands for tasks while having confidence in the security and safe-carrying of the long gun.

An object of the present invention is to provide a long gun holster for holding the long gun on a professional long-gun-owner's garment, such as a MOLLE/PALS-compliant garment, doing so in a manner that provides flexibility and ease of use to the gun-carrying professional, balanced gun-support when holstered but with immediate gun release and quick access, and yet that does so securely, safely, and without interfering with tasks at hand, and while using relatively low cost, non-complex components.

An object of the present invention is to provide a long gun holster with a mount incorporating structural fingers for engaging straps on a MOLLE/PALS-compliant garment, and with a long-gun-supporting structure that securely supports the long gun when the holster's mount is attached to the MOLLE/PALS-compliant garment.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
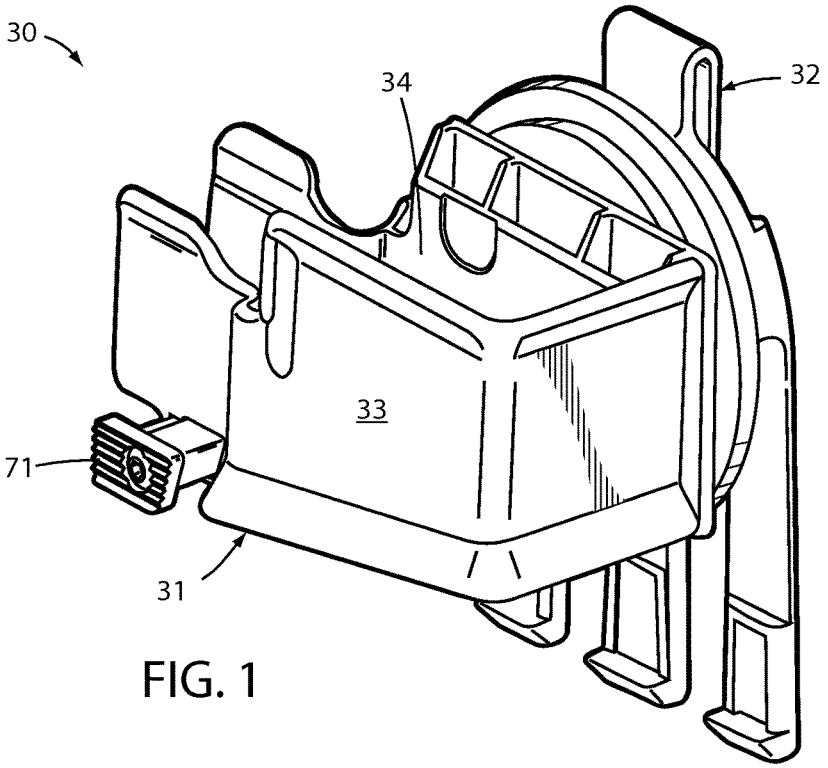
FIGS. 1-3 are top and bottom perspective views and an exploded view of the present holster apparatus, respectively.
Figure 2:
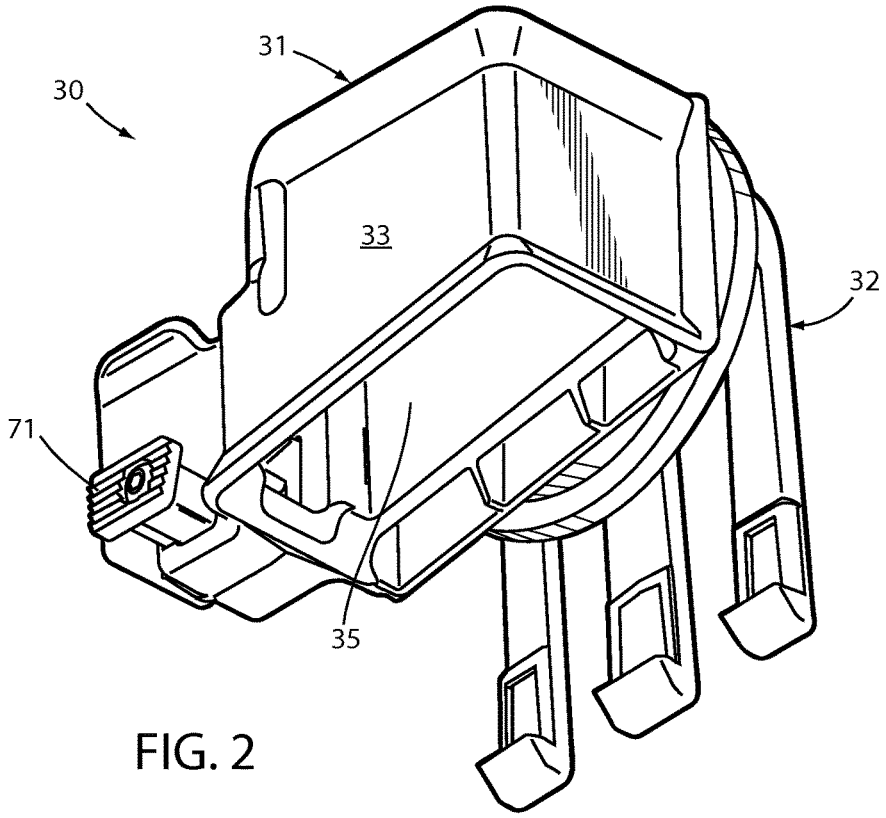
Figure 3:
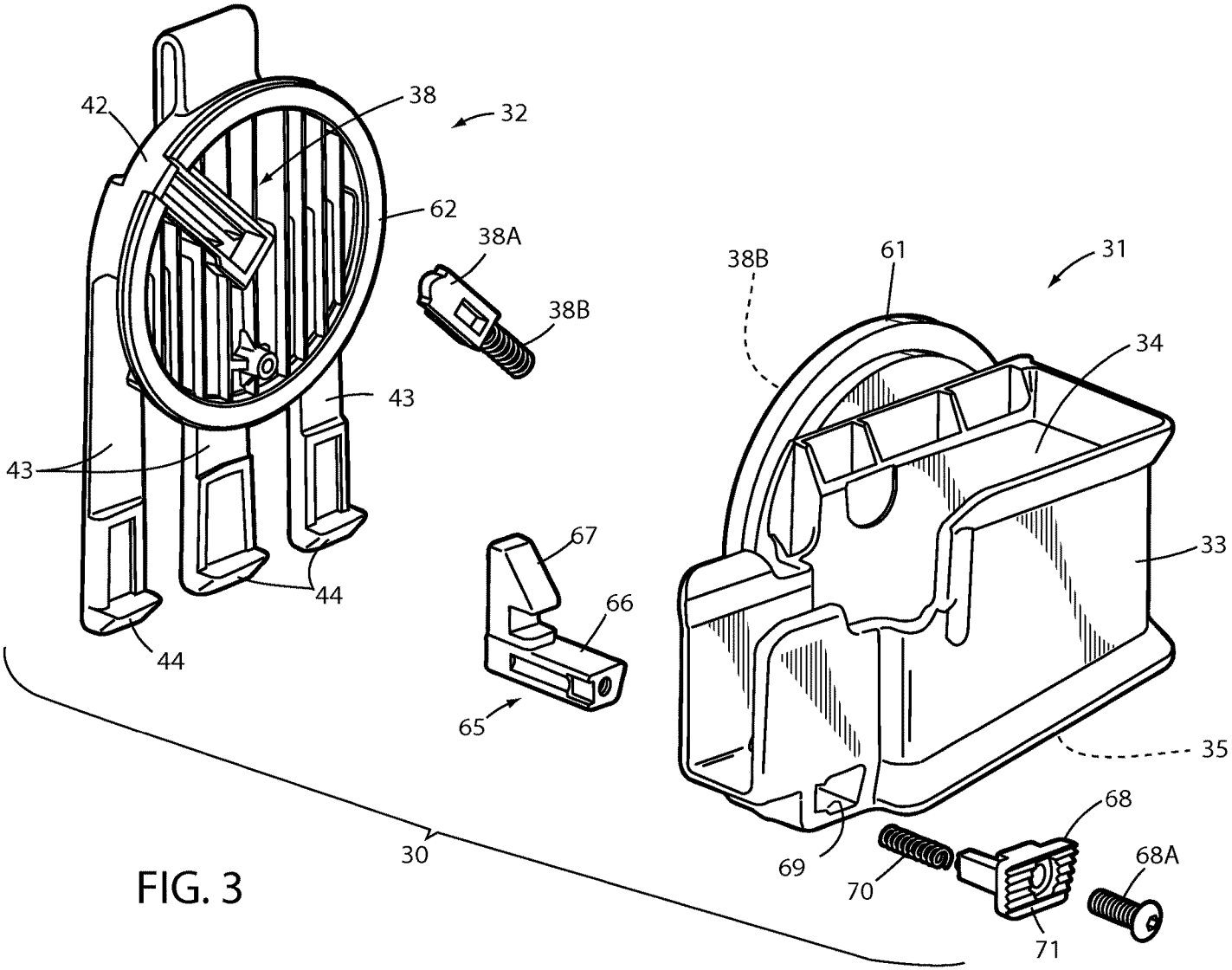
Figure 4:
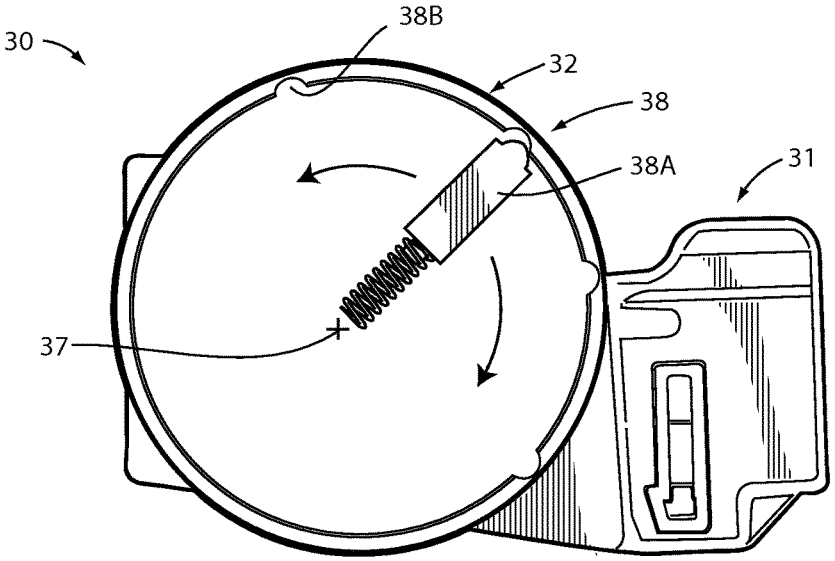
FIG. 4 is a cross sectional view showing a rotation-supporting structure and rotational detent mechanism for allowing detented rotation of the magazine-engaging holster on the garment-engaging mount of FIG. 3.
Figure 5:
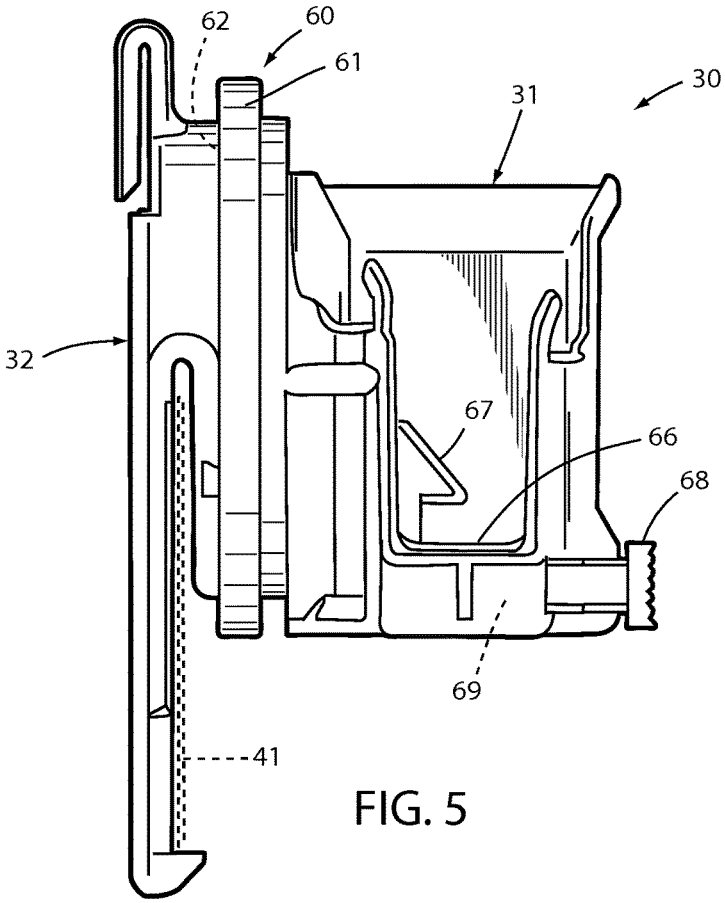
FIG. 5 is a side view of FIG. 1.
Figure 6:
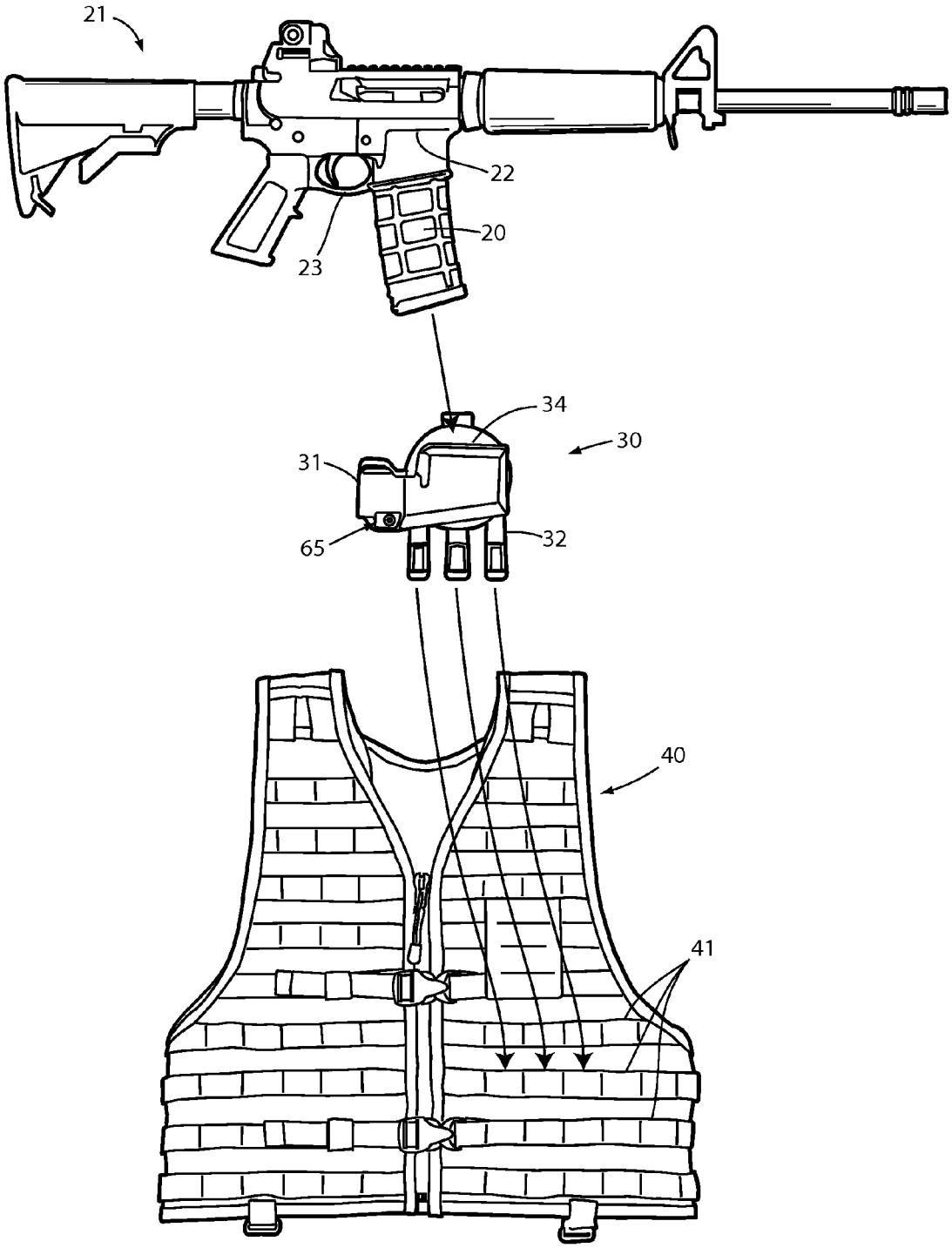
FIG. 6 is a front exploded view of the holster apparatus positioned to receive the long gun with ammunition magazine attached, and showing part of a MOLLE/PALS-compliant garment with horizontal straps for re-positionably engaging and supporting the mount of the holster apparatus.
Figure 7:
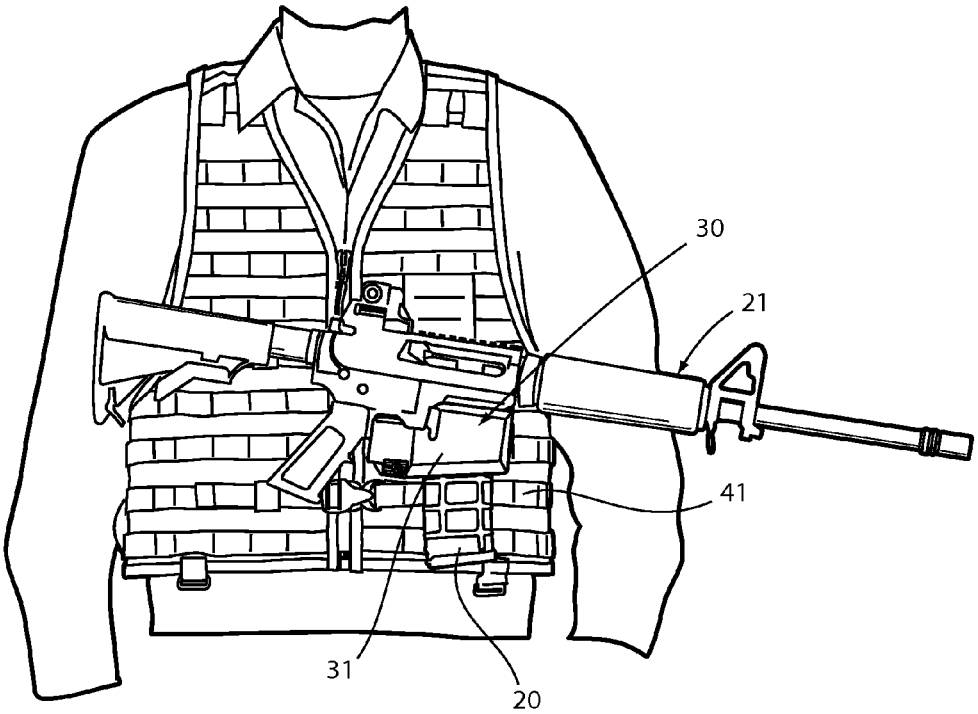
FIG. 7 is a front view of the MOLLE/PALS-compliant garment with attached holster apparatus, including a long gun with ammunition magazine engaging and supported by the holster.

The present holster apparatus 30 (FIGS. 1-5) includes a holster 31 and a mount 32 for supporting a long gun 21 (FIGS. 6-7) with ammunition magazine 20 attached to a MOLLE/PALS-compliant garment 40. The mount 32 pivotally supports the holster 31 (FIGS. 8-9) and also selectively attaches to the MOLLE/PALS-compliant garment 40 (FIG. 7), thus providing optimal personalization for a professional user. It is noted that MOLLE/PALS-compliant garments are generally known and need not be described for an understanding of the present invention. Specifically, the mount 32 selectively engages straps on the garment 40 in a desired location on the garment 40, and the holster 31 can be rotated to a best/preferred orientation for holding the magazine 20 and long gun 21 based on user preference, as described below.

The holster 31 (FIG. 3) includes a generally rectangular housing 33 (also called a "holster body" herein) with magazine-receiving cavity including top and bottom openings 34 and 35. A front wall of the housing cavity is open to permit a trigger guard 23 of the long gun 21 to slip into the housing without interference. The front wall includes and supports a U-shaped portion of the housing 33 where the trigger-guard-engaging latch 65 is located, as described below. The cavity is shaped/configured to slidingly and closely receive and thus stably engage an ammunition magazine 20 concurrently while supporting the long gun 21 (such as a military or police weapon/rifle with long barrel). A shape of the illustrated housing 33 is generally rectangular and slightly longitudinally curved to allow the magazine 20 to slide vertically downward into the holster 31, such that a bottom surface 22 of the long gun 21 is supported on a top of the holster 31. Concurrently, the magazine 20, which is located generally near a center of gravity of the long gun 21, is stably supported by the housing 33 such that the long gun 21 and magazine 20 as a unit are well-balanced when holstered.

A trigger-guard-engaging latch 65 (FIGS. 3, 10-12) is movably supported by the housing 33 to releasably engage a trigger guard 23 on the long gun 21, as described below. Thus, the holster 31 is configured to securely support the long gun 21 (with loaded magazine 20) in a hands-free secure position (as selected by the professional user), but supports the gun 21 so that the gun 21 is quickly and easily accessible simply by (with a single motion) releasing the latch 65 while lifting the long gun 21 (with magazine 20 attached) out of the holster apparatus 30. Thus, when the holster apparatus 30 is positioned on the garment 40 in front of one's chest, the long gun 21 is immediately at the hands of a professional user when grasped and lifted.

The mount 32 holds the holster 31 on a MOLLE/PALS-compliant garment 40 with the holster 31 oriented generally horizontally (FIG. 7) (i.e. with the top and bottom openings 34, 35 of the magazine-engaging cavity of the housing 33 oriented generally vertically). The illustrated mount 32 (FIG. 3) includes a panel body 42 and multiple elongated fingers 43 with finger-tip hooks 44 for selectively engaging straps 41 on the MOLLE/PALS-compliant garment 40. Thus, the mount 32 can be attached anywhere on the garment 40, based on user preference.

Figure 8:
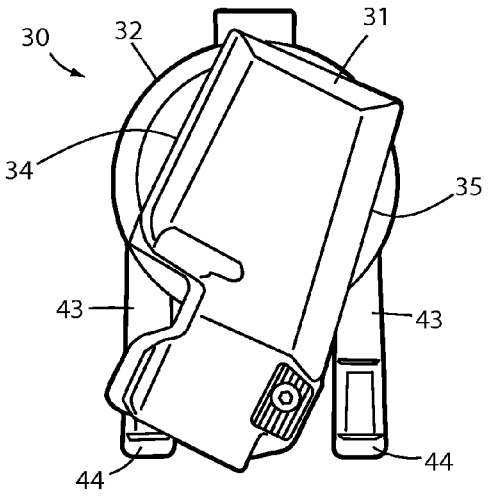
FIGS. 8-9 are front views of the holster apparatus, FIG. 8 showing the holster rotated counter-clockwise and FIG. 9 showing the holster rotated clockwise, for supporting the long gun in different orientations on the professional.
Figure 9:
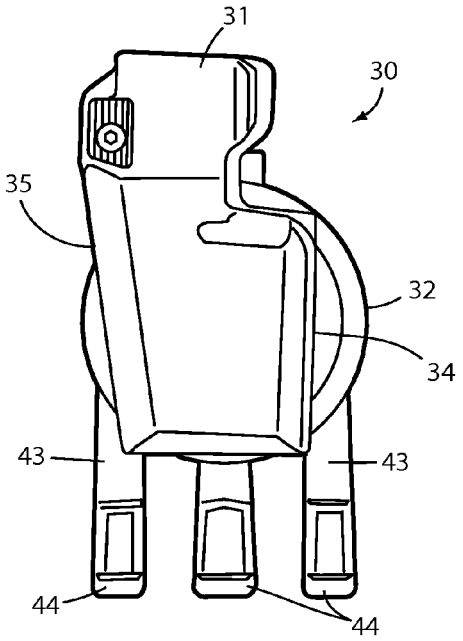
Figure 10:
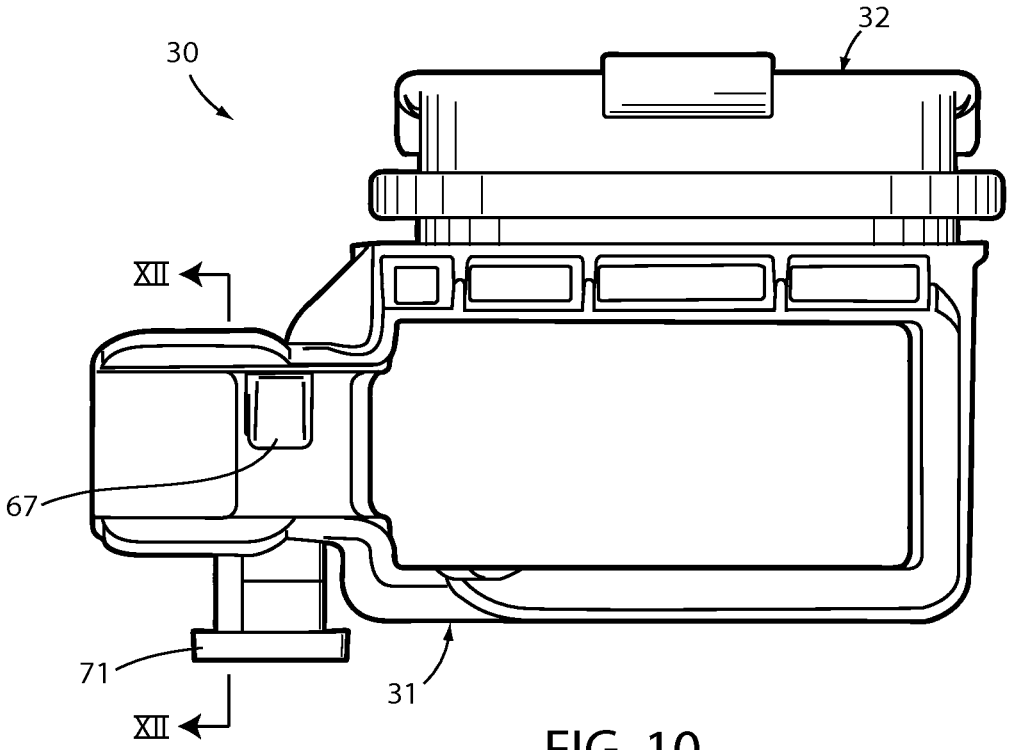
FIGS. 10-11 are top views of the holster apparatus, FIG. 10 showing a trigger-guard-engaging latch in a latched position (where it securely engages the trigger guard to thus hold the long gun in the holster) and FIG. 11 showing the latch in a guard-released unlatched position.
Figure 11:
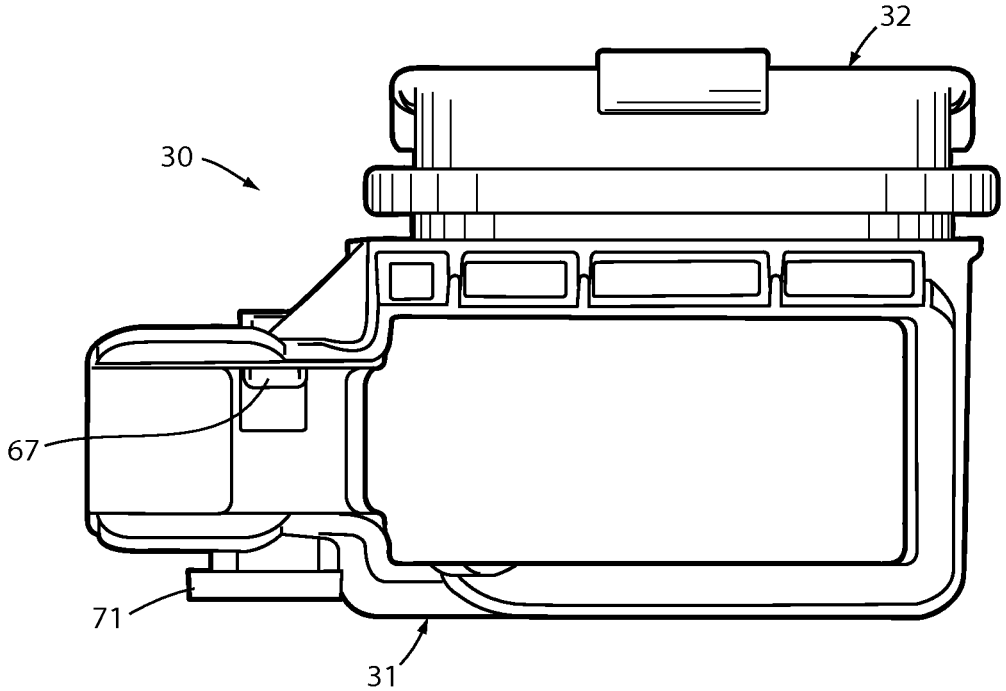
Figure 12:
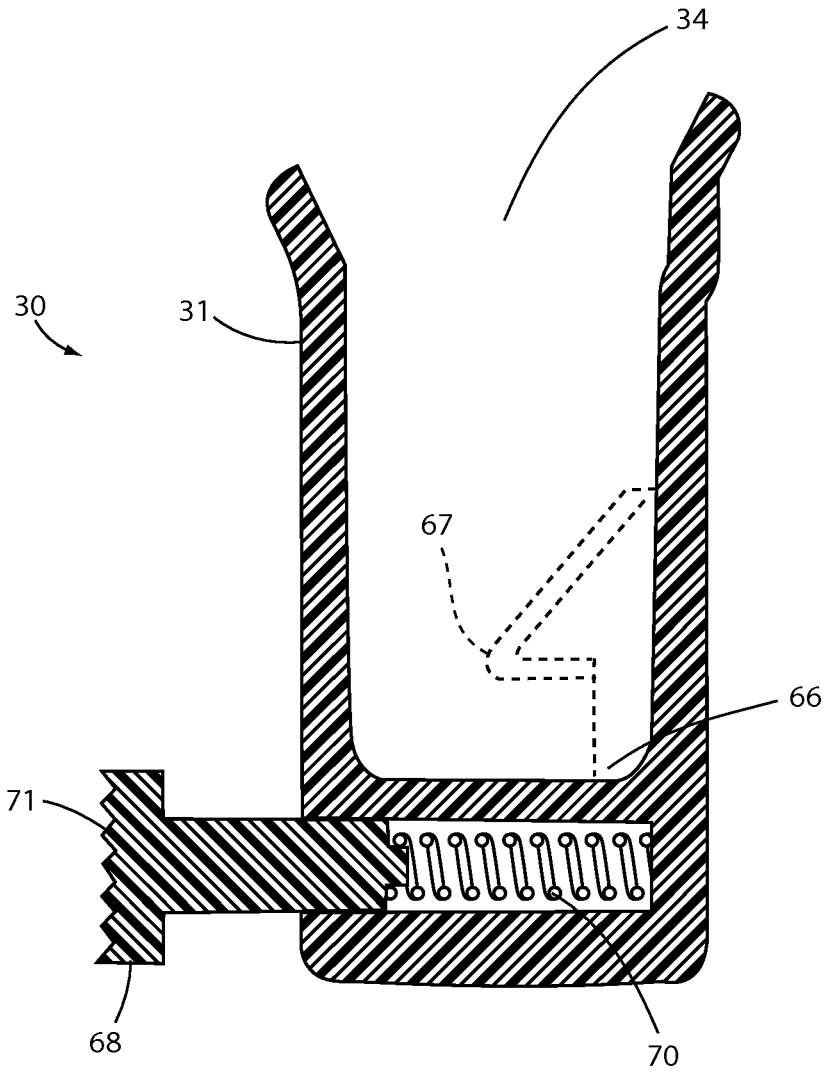
FIG. 12 is a cross sectional view through the trigger-guard-engaging latch of FIG. 10, showing the latch in the latched position

The holster 31 is rotatably supported on the mount 32. It is contemplated that rotation can be provided by a variety of different pivot-forming structures. The illustrated structures providing the rotation are shown in FIGS. 3-5, 8-9, but it is contemplated that a scope of the present innovation includes other pivot structures, such as a bolt or shaft, for rotatably supporting the holster 31 on the mount 32. A detent system 38 (FIGS. 3-4) includes a spring-biased extendable plunger/pin 38A and mating undulations/recesses 38B positioned around the pivot axis 37, the combination of which are designed to hold the holster 31 in a selected rotational position (FIGS. 8-9). The illustrated detent system 38 includes stop(s) on the housing 33 that engage the pin 38A to limit angular rotation of the housing 33 to reasonable angular limits, so that the mount 32 cannot be over-rotated to an orientation where the long gun 21 is rotated into an unsafe holstered position.

FIGS. 1-3, 8-9 show the housing 33 (i.e. holster body) and mount 32 rotatably attached together using a rotatable support 60. The support 60 is formed by two mating planar disc-shapes 61 and 62 of housing 33 and mount 32, respectively. The disc-shapes 61 and 62 can be secured together in different ways. The illustrated disc-shapes 61-62 include mating overlapping annular flanges that interengage to prevent separation, yet that allow rotation of the housing's disc-shape 61 (along with the housing 33) on the disc-shape 62 of the mount 32. Undulations (recesses 38B) on an inside of the structure 60 (or on the housing's disc-shape 61) are engaged by a spring-biased plunger 38A riding on the mount's disc-shape 62, thus forming the detent system 38 designed to hold a selected rotated position.

A security latch 65 (FIGS. 3, 10-12) includes a slide 66 with hook 67, and an end piece 68 secured to the slide 66, such as using a screw 68A. The slide 66 of the security latch 65 slides in a track 69 defined by the housing 33, and is biased to a latched position by a spring 70. The latch 65 is designed to engage the hook 67 with a trigger guard of the rifle/long gun 21 when the gun 21 is holstered. Specifically, the hook 67 includes an upwardly-facing inclined edge so that the latch 65, when engaged by a gun's finger guard 23, will temporarily slide out of the way against a bias of the spring 70 to allow holstering of the long gun 21 as the gun with ammunition magazine 20 is slid into the housing 33, and then will snap into a guard-engaging latched position on the finger guard 23 once the gun 21 is fully holstered. A finger button 71 on the end of the latch 65 extends outward in a position where it can be easily and quickly presssed to release the long gun 21, allowing the user to remove the long gun 21 from the holster apparatus 30 with a single quick motion as the gun 21 is grasped and lifted/de-holstered.

It is contemplated that the mount 32 and holster 31 can be made primarily or entirely of structural polymeric materials. Ribbing and recesses are designed into the holster 31 and mount 32 to minimize weight while optimizing manufacturability, strength and durability. The illustrated holster 31 is a one-piece molding made of a high strength material, such as nylon or other polymer of suitable strength. It is contemplated that the illustrated components can be molded as two halves or multiple components secured together by screw(s) or snap features or welding or using other securement methods. The illustrated housing 33 has upright tapered tabs 45 that form an upright guide adapted to engage and guide opposing sides of the ammunition magazine 20 (and the long gun 21) into the holster apparatus 30 when holstering the gun 21. The upright structures (e.g. tabs 45) also stabilize and help hold the long gun 21 in the holstered position.

The method of use includes providing a holster configured to slidingly engage an ammunition magazine attached to a long gun and configured to engage a bottom surface of the long gun. The method also includes attaching the holster to a MOLLE/PALS-compliant garment with the holster located and oriented to hold the long gun in a hands-free manner, and includes placing the ammunition magazine in the holster with a weight of the long gun being supported by the holster. By this arrangement, a professional can use their hands for tasks while having confidence in the security and safe-carrying of the long gun, while still providing quick access to the long gun.

Thus, it is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A combination apparatus for securely holding a long gun, comprising:

a MOLLE/PALS-compliant garment;

a long gun having an ammunition magazine attached to and extending downwardly from a center region of the long gun and having a trigger guard adjacent the magazine;

a holster with a notch configured to slidingly receive the ammunition magazine and the trigger guard when engaging and supporting a bottom surface of the long gun; and a mount supporting the holster on the garment with the holster oriented to hold the long gun in a hands-free manner, so that a professional can use their hands for tasks while carrying the long gun; and wherein the holster includes a latch for securing the trigger guard of the long gun.

2. The apparatus defined in claim 1, wherein the mount includes attachment structure shaped to engage straps on the MOLLE/PALS-compliant garment.

3. The apparatus defined in claim 2, wherein the attachment structure includes fingers adapted to fit under the straps on the garment.

4. The apparatus defined in claim 3, wherein the mount pivotally supports the holster for holding the holster in a selected rotational orientation.

5. The apparatus defined in claim 4, wherein the holster includes a top opening having a cross section matching a cross section of the ammunition clip.

6. The apparatus defined in claim 5, wherein the holster includes a bottom opening aligned to the top opening.

7. The apparatus defined in claim 4, including a pivot rotatably supporting the holster on the mount and including a detent for fixing a selected orientation of the holster.

8. The apparatus defined in claim 1, wherein the mount pivotally supports the holster for holding the holster in a selected rotational orientation.

9. The apparatus defined in claim 1, wherein the holster includes a top opening having a cross section matching a cross section of the ammunition magazine.

10. The apparatus defined in claim 9, wherein the holster includes a bottom opening aligned to the top opening.

11. The apparatus defined in claim 1, including a pivot rotatably supporting the holster on the mount and including a detent for fixing a selected orientation of the holster.

12. The combination apparatus of claim 1, including a detent system including pivot structure rotationally supporting the holster on the mount and including a radially-extending radially-movable detent pin engaging mating detent stops for holding the holster in a selected rotational position despite a weight of the long gun and magazine and despite movement of the gun owner.

* * * * *